US010799786B2

(12) United States Patent
Riley

(10) Patent No.: US 10,799,786 B2
(45) Date of Patent: Oct. 13, 2020

(54) RELATING TO BOARD GAMES AND DICE

(71) Applicant: Leigh David Riley, Thornbury (AU)

(72) Inventor: Leigh David Riley, Thornbury (AU)

( * ) Notice: Subject to any disclaimer, the term of this patent is extended or adjusted under 35 U.S.C. 154(b) by 0 days.

(21) Appl. No.: 16/315,972

(22) PCT Filed: Jun. 30, 2017

(86) PCT No.: PCT/AU2017/050684

§ 371 (c)(1),
(2) Date: Jan. 7, 2019

(87) PCT Pub. No.: WO2018/009963

PCT Pub. Date: Jan. 18, 2018

(65) Prior Publication Data

US 2020/0001169 A1 Jan. 2, 2020

(30) Foreign Application Priority Data

Jul. 11, 2016 (AU) ..... 2016902709

(51) Int. Cl.
*A63F 3/00* (2006.01)
*A63F 3/04* (2006.01)

(52) U.S. Cl.
CPC ..... *A63F 3/00261* (2013.01); *A63F 3/00006* (2013.01); *A63F 3/0415* (2013.01);
(Continued)

(58) Field of Classification Search
CPC ..... A63F 3/00261; A63F 3/00006; A63F 3/0415; A63F 2003/00435; A63F 2003/00485; A63F 2003/00883
(Continued)

(56) References Cited

U.S. PATENT DOCUMENTS 1,709,660 A * 4/1929 De Bracht ..... A63F 9/1204 273/157 R
2,757,934 A * 8/1956 Dunbar ..... A63F 3/0423 273/272

(Continued)

FOREIGN PATENT DOCUMENTS

ES 250651 7/1980
JP 2009294257 12/2009

(Continued)

OTHER PUBLICATIONS

International Searching Authority, "International Preliminary Report on Patentability" issued in connection with International Patent Application No. PCT/AU2017/050684 dated Mar. 15, 2018, 5 pages.

(Continued)

*Primary Examiner* — Vishu K Mendiratta
(74) *Attorney, Agent, or Firm* — Hanley, Flight & Zimmerman, LLC

(57) ABSTRACT

A game (2) comprising: a game board (11) comprising a series of ridges, each of the ridges (10) comprising a first face (32) and a second face (33), wherein the second face (33) of each ridge (10) faces toward a first player at one side (30*b*) of the game board (11) and the first face (32) of each ridge (10) faces toward a second player sitting opposite the first player at an opposite side (30*a*) of the game board (11); a playing piece (13) comprising a base (44) which corresponds to the faces (32, 33) of the ridges (10); and a die (12) comprising four or more faces (42), each face (42) indicating a numeric value (43), wherein at least one of the numeric values (43) is indicated on at least two of the faces (42).

20 Claims, 10 Drawing Sheets

(52) U.S. Cl.
CPC ..... *A63F 2003/00435* (2013.01); *A63F 2003/00485* (2013.01); *A63F 2003/00883* (2013.01)

(58) Field of Classification Search
USPC ..... 273/261, 284, 287
See application file for complete search history.

(56) References Cited

U.S. PATENT DOCUMENTS

| | | | | | |
|---|---|---|---|---|---|
| 3,791,649 | A * | 2/1974 | Gold | A63F 3/00214 | 273/239 |
| 4,136,883 | A | 1/1979 | Klees | | |
| 4,201,386 | A * | 5/1980 | Seale | A63F 3/0449 | 273/236 |
| 4,257,609 | A * | 3/1981 | Squibbs | A63F 9/1204 | 273/241 |
| 4,819,945 | A * | 4/1989 | Porcheddu | A63F 3/00634 | 273/272 |
| 4,886,278 | A * | 12/1989 | Salter | A63F 3/00 | 273/242 |
| 6,983,937 | B2 * | 1/2006 | Levinson | A63F 3/00097 | 273/248 |
| D539,359 | S * | 3/2007 | Rom | D21/478 | |
| 10,325,516 | B1 * | 6/2019 | Drymiller | A63F 3/00006 | |
| 2005/0104291 | A1 * | 5/2005 | Levinson | A63F 3/00097 | 273/258 |

FOREIGN PATENT DOCUMENTS

| | | |
|---|---|---|
| WO | 2007141774 | 12/2007 |
| WO | 2009019674 | 2/2009 |
| WO | 2018009963 | 1/2018 |

OTHER PUBLICATIONS

International Searching Authority, "International Search Report" issued in connection with International Patent Application No. PCT/AU2017/050684 dated Aug. 24, 2017, 6 pages.

International Searching Authority, "Written Opinion" issued in connection with International Patent Application No. PCT/AU2017/050684 dated Aug. 24, 2017, 9 pages.

Highland Games, "Dice Comparison," available at http://highland-games.co.uk/faq/dice-comparison/, Jul. 1, 2014, 5 pages.

Desch et al., "Snakehead Ridge US 36th Infantry Division Vs 1st Fallschirmjager Division," available at http://www.wwpd.net/2014/06/snakehead-ridge-us-36th-infantry.html, Jun. 11, 2014, 35 pages.

European Patent Office, "Supplementary European Search Report," issued in connection with European Patent Application No. EP17826674, dated Jun. 5, 2019, (2 pages).

* cited by examiner

RELATING TO BOARD GAMES AND DICE

TECHNICAL FIELD

The present invention relates to board games, including virtual board games, and/or components for board games, including virtual components and/or dice, including virtual dice. In a particular aspect, the invention relates to a number-positional board-and-dice game for two players.

BACKGROUND

Board games have been used by people as a form of entertainment for hundreds of years. On this point alone, the provision of any new and entertaining board game is advantageous. Additionally, some board games may be utilised for educational purposes.

An example of a current board game, commonly known as 'snakes and ladders', utilises a ten row by ten column board, with the cells sequentially numbered from one to one hundred. The board is flat and each player uses the same cells, the cells being visible to both players. However, if a board game were to require each player to utilise separate cells of one hundred each, then the use of a flat board with all cells visible to each player may appear more confusing, unclear, jumbled, or less aesthetically appealing.

Thus, it may be advantageous to provide a new game, or board game, which reduces, limits, overcomes, or ameliorates some of the problems, drawbacks, or disadvantages associated with prior art games, or provides an effective, educational, or entertaining alternative to such games.

DISCLOSURE OF THE INVENTION

In one aspect, the invention may provide a game board comprising a series of ridges, each of the ridges comprising a first face and a second face, wherein the second face of each ridge faces toward a first player at one side of the game board and the first face of each ridge faces toward a second player sitting opposite the first player at an opposite side of the game board.

In another aspect, the invention may provide a die comprising four or more faces, each face indicating a numeric value, wherein the numeric values are equal on at least two of the faces.

In one aspect, the invention may provide a game, or kit, or game kit or a board game kit, comprising:

a game board comprising a series of ridges, each of the ridges comprising a first face and a second face, wherein the second face of each ridge faces a first player at one side or end of the game board and the first face of each ridge faces a second player sitting opposite the first player at an opposite side or end of the game board.

The ridges may be prismatic ridges.

In another aspect, the invention may provide a game, or a board game kit, comprising:

a game board comprising a series of ridges, each of the ridges comprising a first face and a second face, wherein the second face of each ridge is visible to a first player and less visible to a second player sitting opposite the first player, and the first face of each ridge is visible to the second player and less visible to the first player.

In another aspect, the invention may provide a game, or a board game kit, comprising:

a game board comprising a series of ridges, each of the ridges comprising a first face and a second face, wherein the slopes or average slopes of first and second faces extend down and away from each other.

In another aspect, the invention may provide a game, or a board game kit, comprising:

a game board comprising a series of ridges, each of the ridges comprising a first face and a second face, wherein the first and second faces extend down and away from each other.

The first and second faces may extend down and away from each other at an angle in the range of 30 to 150 degrees. If the ridges are not flat, then the angle may amount to the average slope or an average angle of the face. For instance, where concave faces are used, the apical angle between the faces may be close to 0 degrees, but the average angle or slope of the faces will be greater. Alternatively, where convex faces are used, the apical angle between the faces may be close to 180 degrees, but the average angle or slope will be less.

In an alternative form, the first and second faces may be substantially vertical and substantially parallel to each other.

In other forms, the angle is in the range of 45 to 135 degrees, or 60 to 120 degrees, or 75 to 105 degrees, or 80 to 100 degrees, or 85 to 95 degrees, or at an angle which is substantially perpendicular.

The first and second faces of each ridge may be upwardly facing. They may meet at an apex.

Further, the first face of one ridge may extend up and away from the second face of an adjacent ridge at an angle in the range of 30 to 150 degrees, or 45 to 135 degrees, or 60 to 120 degrees, or 75 to 105 degrees, or 80 to 100 degrees, or 85 to 95 degrees, or at an angle which is substantially perpendicular.

The ridges may be prismatic ridges. In one form the ridges form the roof of a triangle, with or without a gap at the apex. However, it is envisaged that other shapes or arrangements could be formed. For instance, rather than being flat or planar, the ridge faces could be convex or concave in nature. The faces may even have a crimped profile, but still slope down and away from each other on average.

The first and second faces of adjacent ridges may meet at a trough or gutter.

There may be six to twenty ridges in the series. In particular forms, there may be six, ten, twelve, fourteen, or sixteen ridges.

The ridges may comprise or be divided into cells. The game board may comprise a ridge divider for visually dividing the ridges into cells. The ridge divider may comprise, for instance, recesses defined by the ridges indicating cell borders, ridge projections indicating cell borders, printing on the ridges indicating cell borders, and/or a sheet or sheets adhered on to the topsurface of the ridges to indicate cell borders. Each ridge may comprise a number of cells which is equal to the total number of ridges. The cells may be arranged side by side, lengthwise along their respective ridges. Thus, each ridge may comprise a row of cells. Each cell may extend over conjoint faces, or first and second faces, of their respective ridge. Thus, each cell may comprise a first cell face on the first face of the ridge and a second cell face on the second face of the ridge.

The cells of each ridge may be aligned to form columns. The number of columns may be equal to the number of cells of a ridge, or the number of ridges, or the number of rows of cells. The columns and rows of cells may form a cell grid.

The number of cells in a column may be equal to the number of cells in a row. Where this is the case, the number of cells per row or column is defined as 'M'. The number of ridges may also be equal to M.

The number of cells in the cell grid may be equal to the number of cell columns times the number of cell rows. The cell grid may be rectangular. The number of columns may equal the number of rows. There may be an even number of rows and/or columns. The number or rows and/or columns may be six, ten, twelve, fourteen or sixteen.

The game board kit may further comprise a tablature. The tablature may be printed or adhered on to the ridges. The tablature may comprise numerals. Each of the numerals may be displayed or disposed on or otherwise occupy a single cell face. Each of the cell faces may contain or display numerals. The numerals may form a two digit number. The two digit numbers may be cell numbers or numeric cell labels. The cell numbers may be arranged into columns and rows. Thus, the number of columns of cell numbers may be equal to the number of columns of cell faces, being the number of columns of cells, and the number of rows of cell numbers may be the number of rows of cell faces, being twice that of the number of cells. In particular forms, it is envisaged that the number of columns of cell numbers or cells may be equal to any even number, although preferably it is greater than or equal to six, and is commonly equal to ten, twelve or sixteen.

The numerals may be arranged in a sequence. Side adjacent cell faces may differ by a numeral of one. The range of numeral values may be from zero to M−1, for M previously defined, where values greater than nine may be indicated by letters successively from 'a', in the conventional manner for higher-base numeration, or by characters designed specifically for the purpose, whose meaning will be given by their place in the numeration sequence. The range of integer values may be from zero to M squared, minus 1. Each integer value in the range may be displayed twice. Thus, there may be two ranges of integer values. The first range of integer values may be displayed on the first cell faces, and the second range of integer values may be displayed on the second cell faces.

The first range of integer values may increase from cell face to cell face from left to right of the board (i.e. from left to right from the first player's viewpoint). The second range of integer values may increase from cell face to cell face from right to left of the board (i.e. from left to right from the second player's viewpoint). A numeral displayed on a first ridge face, in the same column as another numeral but on a subsequent first ridge face (i.e. the adjacent ridge behind from the first player's view point), will be greater in value by the number of cell columns or cell rows. A numeral displayed on a second ridge face, in the same column as another numeral but on a preceding second ridge face (i.e. the adjacent ridge behind from the second player's view point), will be greater in value by the number of cell columns or cell rows.

The kit may comprise playing pieces, each comprising a base which corresponds to the faces of the ridges. The base may comprise a first face and a second face. The first and second faces may be downwardly facing. They may meet at a vertex. The first face of the base may correspond with the first face of a ridge, or first cell face, and the second face of the base may correspond with the second face of the ridge, or second cell face.

The first and second faces of the base may extend down and away from each other at an angle (or average angle or slope) in the range of 30 to 150 degrees. In other forms, the angle or slope is in the range of 45 to 135 degrees, 60 to 120 degrees, or 75 to 105 degrees, or 80 to 100 degrees, or 85 to 95 degrees, or at an angle which is substantially perpendicular. In another form, the first and second faces of the playing piece base may be substantially vertical and substantially parallel to each other. The kit may comprise a die with four or more faces. The die may contain points, numerals or figures indicating a numeric value. The figures may be Arabic numbers. There may be one numeric value indicated on each face. The numeric values may be equal on at least two faces. The numeric amounts may be equal on opposite faces of the die. The die may display the full range of integer numeric values from one up to the value of the number of faces minus one. The die may contain six, eight, ten, twelve, or sixteen faces. 'N' may be defined as the highest number displayed on a die. N may be equal to half of M.

The number of die faces ('Q') divided by the highest number displayed on the die (N), may produce an integer value plus a remainder. One or more numeric values on the die may be displayed on a greater number of faces than the remaining numeric value or values. Thus, unlike a typical die with an even probability distribution, the die of the present invention may have a weighted probability distribution, with each of the numeric value or values present on a greater number of faces being more likely to arise than each of the remaining numeric value or values present on a lesser number of faces. One or more of the numeric values may each be displayed on one more face than each of the remaining numeric values.

In another aspect, the invention may provide a die comprising four or more faces, each face indicating a numeric value, wherein at least one of the numeric values is indicated on at least two of the faces, and at least one of the numeric values occurs more often than at least one remaining numeric value, such that the probability distribution of numeric values is weighted. The or each of the numeric values occurring more often than the at least one remaining numeric value, may occur only once more often. Dividing the number of faces by the highest integer value may leave a non-zero remainder.

In another aspect, the invention may provide a numeric value determination means, wherein the probability distribution of the numeric values is weighted. The numeric value determination means may comprise a die.

In another aspect, the invention provides a method for playing a board game comprising the steps of:

A method of playing a game comprising the steps of:

providing a game board comprising a series of ridges, each of the ridges comprising a first face and a second face, wherein the first and second faces are sloped, on average, down and away from each other, each of the ridges comprising a row of cells, the cells of each row being aligned into columns traversing the ridges, each cell comprising a first cell face on the first face of its respective ridge and a second cell face on the second face of its respective ridge, each cell face displaying a numeral;

providing a plurality of pieces for each of the game players, each piece comprising a base having first and second faces which correspond with the first and second faces of the ridges, the base of each piece fitting within the bounds of each cell;

providing at least two dice having multiple faces displaying figures indicative of numeric values, wherein at least two faces of each die display figures indicative of an identical numeric value;

placing multiple pieces for each player on separate cells of the game board;

taking turns by each player alternately rolling or juggling the dice, and then moving one of their pieces side-to-side, forwards, or backwards, across a number of cells equal to the summed score of the rolled dice.

The game/game kit and method described herein may be implemented on a computer. Thus, the three dimensional objects defined herein may be displayed on a two dimensional screen. Thus, features of the various physical parts described herein are defined as including their virtual counterparts, be they representations or non-tangible extractions of the physical parts, or functional emulations or simulations of them. Therefore, for instance, the terms 'game board' and 'ridges' are to be taken to include within their scope a 'virtual game board' and 'virtual ridges' respectively.

In another aspect, the invention may provide a method of playing a game comprising the steps of:

providing a game board comprising a series of ridges, each of the ridges comprising a first face and a second face, each of the ridges comprising a row of cells, the cells of each row being aligned into columns traversing the ridges, each cell comprising a first cell face on the first face of its respective ridge and a second cell face on the second face of its respective ridge, each cell face displaying a numeral;

providing a plurality of pieces for each of the game players, the base of each piece fitting within the bounds of each cell;

providing at least two dice having multiple faces displaying figures indicative of numeric values, wherein at least two faces of each die display figures indicative of an identical numeric value;

placing multiple pieces for each player on separate cells of the game board;

taking turns by each player alternately playing the dice and moving one of their pieces side-to-side, forwards, or backwards, across a number of cells equal to the summed score of the rolled dice.

In another aspect, the invention may provide an apparatus for playing a game comprising:

a computer system, a game board comprising a series of ridges, each of the ridges comprising a first face and a second face, each of the ridges comprising a row of cells, the cells of each row being aligned into columns traversing the ridges, each cell comprising a first cell face on the first face of its respective ridge and a second cell face on the second face of its respective ridge, each cell face displaying a numeral;

a plurality of pieces or markers for each game player;

at least two dice having multiple faces displaying figures indicative of numeric values, wherein at least two faces of each die display figures indicative of an identical numeric value;

means, in said computer system, for placing multiple pieces or markers for each player on separate cells of the game board;

means, in said computer system, for taking turns for each player by alternately playing the dice and moving one of their pieces or markers side-to-side, forwards, or backwards, across a number of cells equal to the summed score of the rolled dice.

In another aspect, the invention may provide a server for playing a game, the server comprising:

a processor and a memory including computer-executable instructions, one or more computing devices to be in selective communication with the server through a communications network;

wherein a user or users of the one or more computing devices are able to access the server to play the game by:

providing a game board comprising a series of ridges, each of the ridges comprising a first face and a second face, each of the ridges comprising a row of cells, the cells of each row being aligned into columns traversing the ridges, each cell comprising a first cell face on the first face of its respective ridge and a second cell face on the second face of its respective ridge, each cell face displaying a numeral;

providing a plurality of pieces or markers for each of the game players, providing at least two dice having multiple faces displaying figures indicative of numeric values, wherein at least two faces of each die display figures indicative of an identical numeric value;

placing multiple pieces or markers for each player on separate cells of the game board;

taking turns by alternately playing the dice for each player and moving one of their pieces or markers side-to-side, forwards, or backwards, across a number of cells equal to the summed score of the rolled dice.

In another aspect, the invention may provide a computer-readable medium comprising computer executable instructions that, when executed on a processor, direct a processor to at least:

provide a game board comprising a series of ridges, each of the ridges comprising a first face and a second face, each of the ridges comprising a row of cells, the cells of each row being aligned into columns traversing the ridges, each cell comprising a first cell face on the first face of its respective ridge and a second cell face on the second face of its respective ridge, each cell face displaying a numeral;

provide a plurality of pieces or markers for each of the game players, provide at least two dice having multiple faces displaying figures indicative of numeric values, wherein at least two faces of each die display figures indicative of an identical numeric value;

place multiple pieces or markers for each player on separate cells of the game board;

take turns by alternately playing dice for each player and moving one of their pieces or markers side-to-side, forwards, or backwards, across a number of cells equal to the summed score of the rolled dice.

In another aspect, the invention may provide a method of playing a game comprising the steps of:

providing a game board comprising rows of cells, the cells of each row being aligned into columns traversing the rows, each cell comprising first and second cell faces, each cell face displaying a numeral;

providing a plurality of pieces or markers for each of the game players; providing numeric value determination means, wherein one or more numeric values is produced with each play, and wherein the probability distribution of the numeric values is weighted;

placing multiple pieces or markers for each player on separate cells of the game board;

taking turns alternately playing the numeric value determination means for each player and moving one of their pieces side-to-side, forwards, or backwards, across a number of cells equal to the numeric value or sum of numeric values produced.

The method may be implemented by a computing device or system of computing devices.

In another aspect, the invention may provide an apparatus for playing a game comprising:

a computer system, a game board comprising rows of cells, the cells of each row being aligned into columns traversing the rows, each cell comprising first and second cell faces, each cell face displaying a numeral;

a plurality of pieces or markers for each game player;

at least two dice having multiple faces displaying figures indicative of numeric values, wherein at least two faces of each die display figures indicative of an identical numeric value;

means, in said computer system, for placing multiple pieces or markers for each player on separate cells of the game board;

means, in said computer system, for taking turns for each player by alternately playing the dice and moving one of their pieces or markers side-to-side, forwards, or backwards, across a number of cells equal to the summed score of the rolled dice.

In another aspect, the invention may provide a server for playing a game, the server comprising:

a processor and a memory including computer-executable instructions, one or more computing devices to be in selective communication with the server through a communications network;

wherein a user or users of the one or more computing devices are able to access the server to play the game by:

providing a game board comprising rows of cells, the cells of each row being aligned into columns traversing the rows, each cell comprising first and second cell faces, each cell face displaying a numeral;

providing a plurality of pieces or markers for each of the game players, providing at least two dice having multiple faces displaying figures indicative of numeric values, wherein at least two faces of each die display figures indicative of an identical numeric value;

placing multiple pieces or markers for each player on separate cells of the game board;

taking turns by alternately playing the dice for each player and moving one of their pieces or markers side-to-side, forwards, or backwards, across a number of cells equal to the summed score of the rolled dice.

In another aspect, the invention may provide a computer-readable medium comprising computer executable instructions that, when executed on a processor, direct a processor to at least:

provide a game board comprising rows of cells, the cells of each row being aligned into columns traversing the rows, each cell comprising first and second cell faces, each cell face displaying a numeral;

provide a plurality of pieces or markers for each of the game players, provide at least two dice having multiple faces displaying figures indicative of numeric values, wherein at least two faces of each die display figures indicative of an identical numeric value;

place multiple pieces or markers for each player on separate cells of the game board;

take turns by alternately playing dice for each player and moving one of their pieces or markers side-to-side, forwards, or backwards, across a number of cells equal to the summed score of the rolled dice.

BRIEF DESCRIPTION OF THE DRAWINGS

In order that the invention may be more clearly understood and put into practical effect there shall now be described in detail preferred embodiments of a board game in accordance with the invention. The ensuing description is given by way of non-limitative examples only and is with reference to the accompanying drawing, wherein:

FIG. 8(*b*) is a rear perspective view of the playing piece of FIG. 7;

MODES FOR CARRYING OUT THE INVENTION

Figure 1:
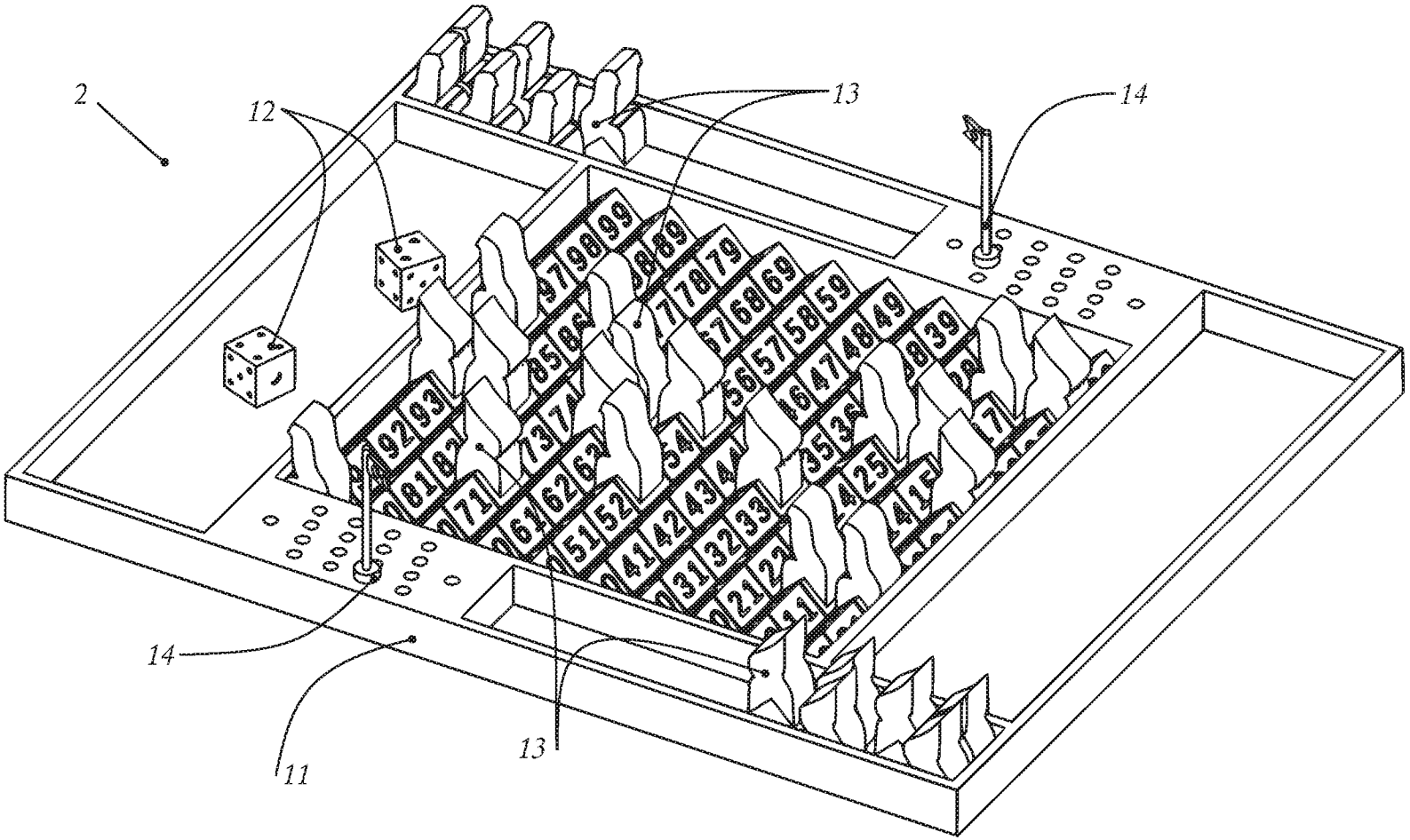
FIG. 1 is a front perspective view of a suitable embodiment of a game kit/apparatus with components assembled, and in game play.
Figure 2:
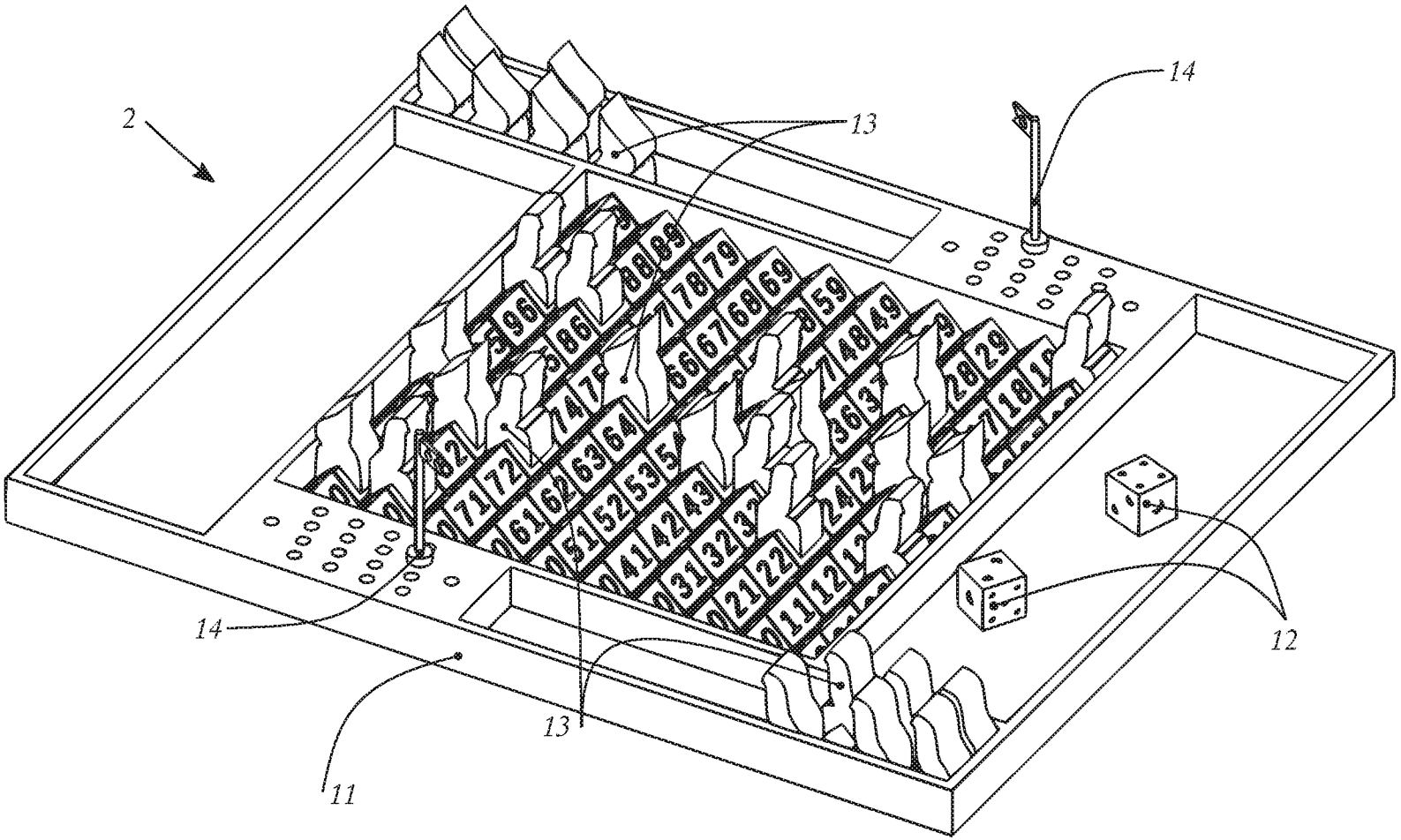
FIG. 2 is a rear perspective view of the game kit of FIG. 1.

Referring to FIGS. 1 and 2, there is shown a game apparatus or kit, generally designated 2. The game kit 2 comprises a game board 11, a pair of dice 12, playing pieces 13, and scoring flags 14.

Figure 3:
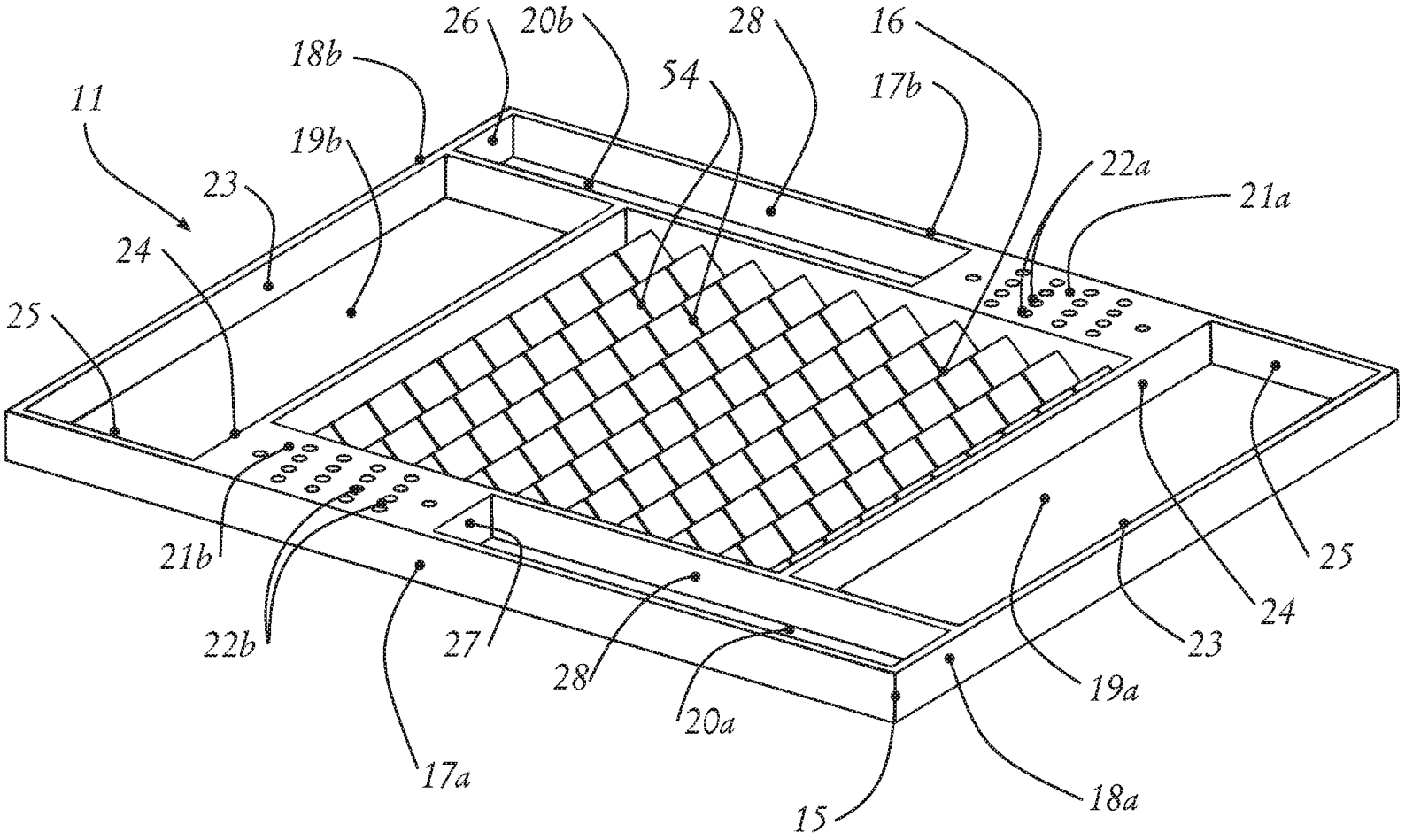
FIG. 3 is a front perspective view of a game board of the game kit.

The game board 11, as shown in FIG. 3, is rectangular in shape, having a rectangular base 15 and a smaller rectangular field insert 16 mounted on to the base 15. Peripherally, the base 15 has a pair of parallel long sides, 17*a* and 17*b* respectively, and a pair of parallel shorter sides or ends, 18*a* and 18*b* respectively, extending perpendicularly between the long sides.

The base 15 defines a pair of rectangular throwing bowls or recesses, 19*a* and 19*b*, parallel with and adjacent to respective ends, 18*a* and 18*b*. The throwing recesses 19 are each bounded by an outer wall 23, an inner wall 24 parallel with the outer wall 23, and shorter lateral walls 25 extending perpendicularly between the outer and inner walls, 23 and 24 respectively.

The base 15 further defines a pair of rectangular holding bowls or recesses, 20*a* and 20*b*, parallel with and adjacent to respective sides, 17*a* and 17*b*, and perpendicular with and adjacent to respective throwing recesses 19*a* and 19*b*. The holding recesses 20 are each bounded by an outer wall 26, an inner wall 27 parallel with the outer wall 26, and longer lateral walls 28 extending perpendicularly between the outer and inner walls, 23 and 24 respectively.

The base further comprises a pair of elevated scoring racks, 21*a* and 21*b*. Scoring rack 21*a* runs along side 17*b*, between throwing recess 19*b* and holding recess 20*a*, whereas scoring rack 21*b* runs along side 17*a*, between throwing recess 19*b* and holding recess 20*b*. The scoring racks, 21*a* and 21*b*, define sets of circular flag holes, 22*a* and 22*b* respectively. Each set of flag holes 22 is arranged in six rows, there being one flag hole in each of the outer and inner rows, and four flag holes in each of the four remaining rows located between the outer and inner rows.

Figure 4:
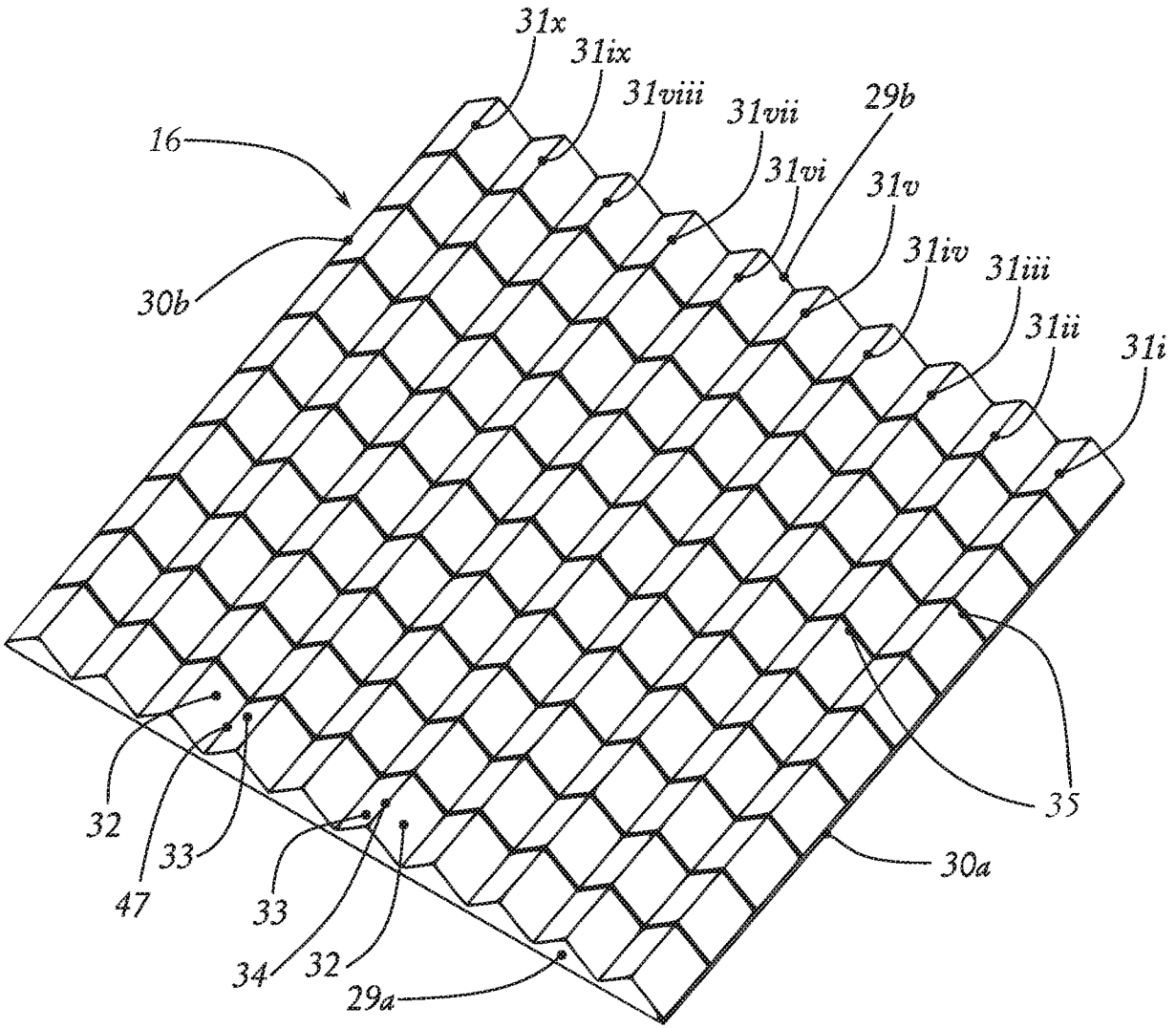
FIG. 4 is a front perspective view of a field insert mounted on the game board.

Referring now to FIG. 4, the field insert 16 has a pair of parallel long sides, 29*a* and 29*b*, and a pair of parallel short sides or ends, 30*a* and 30*b*, extending perpendicularly between the long sides. A series of adjacent prismatic ridges, here ten, being 31*i*-31*x*, extends from end 30*a* to end 30*b*. Each ridge 31 extends perpendicularly between long sides 29, and in parallel with ends 30 and adjacent ridges. Each ridge 31 comprises a first face 32 and a second face 33, which faces meet at an apex 34. The bottom edge of the first face 32 of each ridge 31 meets the bottom edge of the second face 33 of an adjacent ridge at a gutter 47, except for ridge 31*i* where the first face 32 terminates at end 30*a*. The second face 32 of ridge 31*x* terminates at end 30*b*, and so does not meet the first face of an adjacent ridge. The angle at which ridges meet, i.e. the angle at which the bottom edges of first and second faces meet, is perpendicular, in this instance. Similarly, the angle at which the top edges of first and second faces meet to form the ridge apex is ninety degrees, in this instance.

In the embodiment shown, each ridge 31 is twice as wide as it is high. That is, the distance between the first and second faces, 32 and 33, at their bottom edges is twice that of the height, as measured from midpoint of a line drawn between the bottom edges of the first and second faces and the apex 34.

The ridges comprise ridge projections 54 which act as border markers dividing the length of each ridge into a series or row 58 of ten equally sized rectangular cells 55. Each cell extends over conjoint first and second faces of their respective ridge. Thus, each cell comprises a first cell face 56 on the first face of the ridge and a second cell face 57 on the second face of the ridge. Each of the ten cells of each ridge is aligned to form a column 59 of cells which traverse the ten ridges, thereby forming a ten column by ten row rectangular grid of cells.

Figure 5:
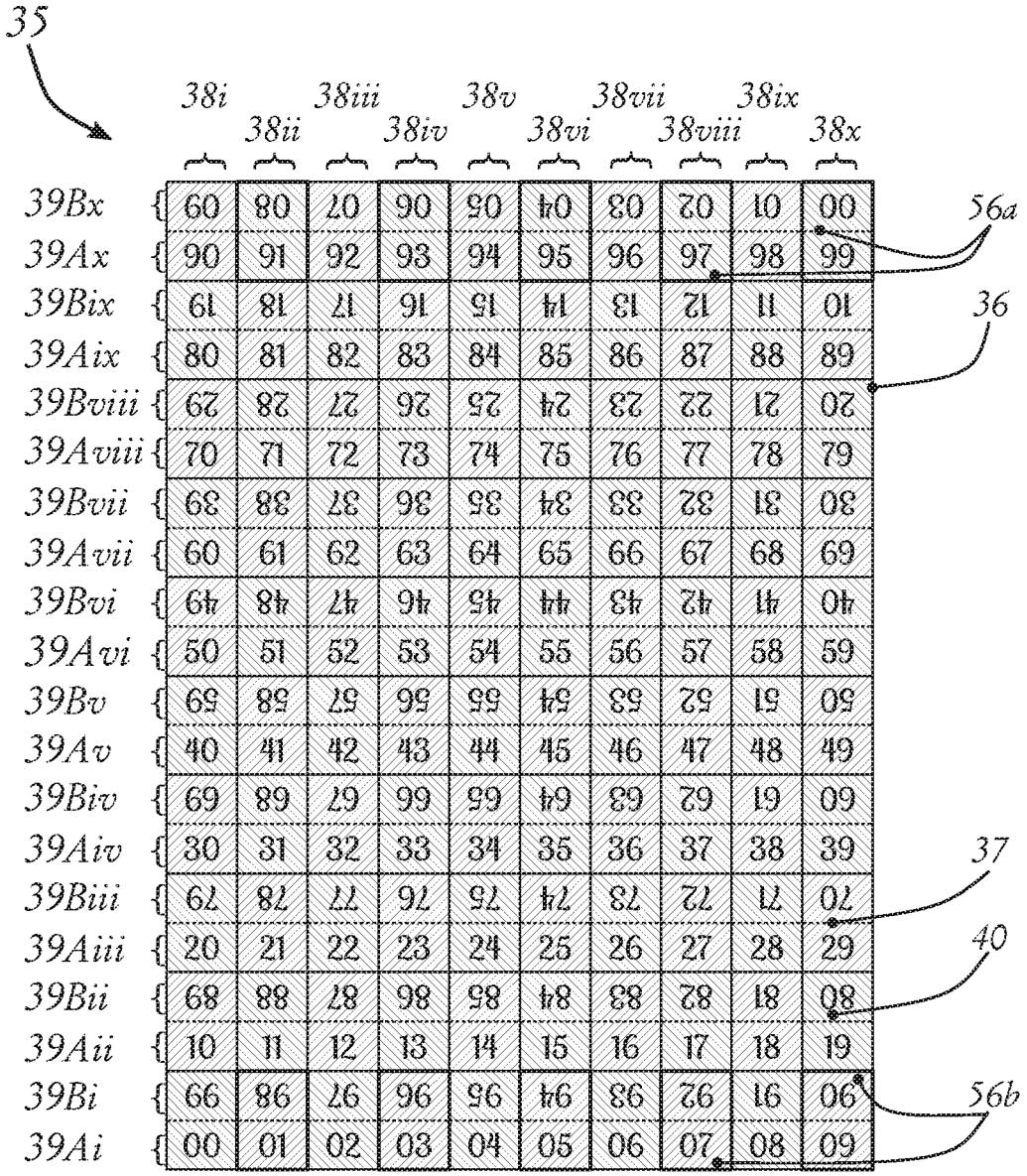
FIG. 5 is a front perspective view of a tablature placed on the field insert.

With reference to FIG. 5, the game board kit 10 further comprises a tablature sheet 35 mounted on the set of ridges 31 so as to be adhered to the ridge faces 32, 33 therebeneath. The tablature sheet 35 displays a sequence of numerals or numbered faces 40, each of which overlies a cell face. Thus, the number of numbered faces is equal to the number of cell faces, with the number of rows of numbers being twice the number of columns of numbers and twice the number of columns of cells. In this instance, the numbered faces are arranged in a ten column 38 by twenty row 39 rectangular grid 36 of numbers. Thus, the total number of numbered faces is equal to the number of number columns times the number of number rows, that being two hundred in this instance. The length of each ridge 31 may approximately equal the number of columns of cells, or columns of numerals, times its cell width. In applying to this instance, there are ten columns of cells/numerals so the length of each ridge is ten times its cell width.

The ten numeral columns 38 are arranged in a series from the first column 38*i* to the tenth column 38*x*. The twenty numeral rows 39 are further subdivided into ten 'A' rows 39A overlying the first faces 32 of the ridges 31 and ten 'B' rows 39B overlying the second faces 33 of the ridges 31. The A and B rows are ordered alternately, starting with the first A row 39Ai at end 30*a* of the field insert 16, followed by the first B row 39Bi adjacent the first A row, with this alternate pattern continuing all the way back to the tenth B row 39Bx at end 30*b* of the field insert 16.

Each cell face 37 displays a two-digit number 40. The numbers in each face are oriented with their top towards the apex of the prismatic ridge on which they reside, which is the midline of each pair of rows 39A and 39B. Seen from above, as shown on the tablature, alternate rows will be relatively upside down. Seen from the playing position, each player will see the numbers on the faces in their view in the conventional orientation, and will not see the numbers in the view of their opponent. Thus, a first player sitting at end 30*a* of the field insert 16 will view the numerals of the A row as upright, whilst a second player sitting at end 30*b* of the field insert 16 will view the numerals of the B row as upright. Further, given the angle of the first faces 32 sloping down from the apex towards the first player, and away from the second player, the numerals of the A row are generally visible only to the first player. Similarly, given the angle of the second faces 33, sloping down from the apex towards the second player, and away from the first player, the numerals of the B row are generally visible only to the second player. Such an arrangement reduces visual clutter for the players, with only the numbers relevant to their game play being visible to them.

In each A row 39A, the value of each numeral increases by one from left to right, starting from zero-zero in in the left-most face of the first A row 39Ai, being an increment in the units digit, from one to the number of numeral columns minus one, here nine. For the left-most face of the subsequent A rows, the numbers commence at a value equal to the number of cells per row and column—'M'—greater than for the left-most face of the previous row, being an increment of 1 in the M's digit, from one to M minus one, here nine. For each B row, the opposite is true, with the value of each number incrementing in the units place from right to left, starting at the rightmost face of, here, the tenth B row 39Bx. Successive B rows from 39Bi will decrement the numbers in each face by one in the M's place from M minus one, here nine, to zero in the furthest row, here 39Bx.

Adding the number on any face in an A row to the number of its conjoined face in the corresponding column of the adjacent B row will result in a value of $M^2$ minus 1. For instance, in the example shown, adding the number of cell 39Aiv, 38*iii*, which is thirty two, to the number of row adjacent cell 39Biv, 38*iii*, which is sixty seven, results in a value of ninety nine, that being the number of columns (ten) squared minus one.

Figure 6:
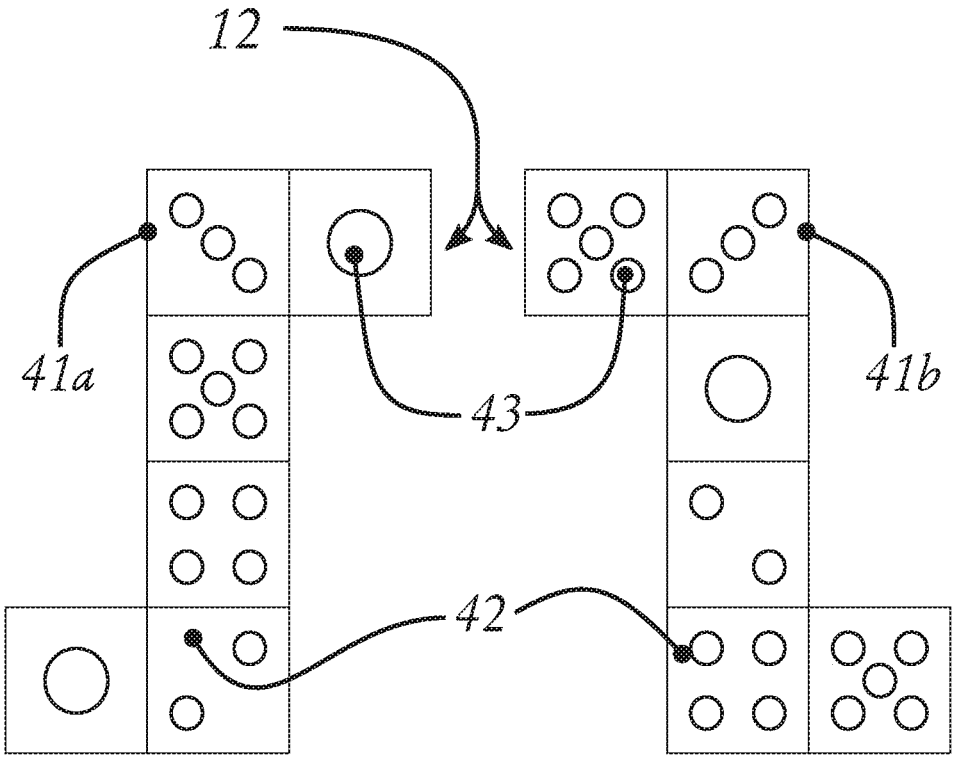
FIG. 6 is a diagram of nets for two dice in the game kit.

FIG. 6 shows nets 41 illustrating the configuration of dice 12. Each net 41 has six faces 42 which constitute the sides 42 of the dice. Each face 42 displays an integer number or figure indicative of an integer number 43. However, whilst conventional six-sided dice are numbered from one to six, the numbering 43 of these six-sided dice 12 differs in that the highest number carried by the die 'N' is the number of cell columns or cell rows M divided by two, and in consequence one number 43 is duplicated on its opposing sides 42. In example net 41*a*, the number one is repeated on opposing faces/sides 42 of the dice 12, whilst the number six is omitted and the number five is the highest number carried. In example die/net 41*b*, the number five is repeated on opposing faces/sides 42 of the dice 12, whilst the number six is again omitted and the number five is again the highest number carried. The pair of dice shown are complementary, and are to be played together. An alternative arrangement equally suitable where M equals ten would be to duplicate the threes, and to play with two identical dice.

Considering now the general case, of dice suitable for any M, a die may be an isohedral solid with Q faces displaying numbers from 1 to N with $N<Q$ and $Q \equiv N \neq 0$, there being indices A and D given by $Q-AN=D$, for $A>0$ and $0<D<N$, where A+1 is the degree of the multiplicated faces and D the number of sets of those multiplicated faces, and, by continuation, A is the degree of the submultiplicated faces and N−D the number of sets of such submultiplicated faces, further decrementing A and diminishing N by D for the lesser multiplicities until exhausted. An example will be a die with 12 faces, numbered for a game of dimension M=10, where N=5, A=2, D=2, and N−D=3, giving the degree of multiplicity to be 3, or the triplication of a face or faces, there being 2 such sets, and that the submultiplicity will be 2, there being 3 such sets, this construction exhausting all faces, there being no faces singly numerated.

Such a die, or any die of the general case, being constructible, it may further have all its equally-numerated and multiplicated faces mutually opposed, some of its multiplicated faces opposed by otherwise-numerated multiplicative faces of the same degree, or some of its multiplicative faces opposed by otherwise-numerated faces of different degree, being types 'synal', or 'same-wise', allal, or 'other-wise', and xenal, or 'strange-wise'.

Such a die, or any die of the general case, being synal, may have the numeration of all its faces, both singular and multiplicative, arranged to produce a constant sum of opposite faces, determinately N+1, in the manner common to historical and traditional dice, this being a regular constant and the die thereafter characteristically 'synal regular'. By way of example, take a die Q6N5 with duplicate 3s opposed and all other faces opposed summing to 6, with type description Q6N5Sr6, a pair of such dice forming a proper set for the playing of the game in dimension M=10.

Another die, being synal, may have opposed pairs of equally-numerated and multiplicated faces summing otherwise, while all opposed pairs of singular and uniquely-numerated faces sum to a constant, being the conformal constant, and the die thereafter characteristically 'synal conformant'. A proper set of such dice, suitable for playing the game in dimension M, shall be a complementary pair with the same parameters and indices Q, N, A and D having respective conformal constants summing to 2(N+1). By these criteria we see that the die in 41*a* of FIG. 6 is synal conformant with the type description Q6N5Sc7, and the die 41*b* of FIG. 6 is synal conformant with the type description Q6N5Sc5, and these are a proper set for a game of dimension M=10, having complementary conformal constants summing to 12.

Similarly, any die of the general case being allal, may have all opposed faces summing to a regular constant N+1, and thereafter characteristically 'allal regular', or may have all opposed pairs of singular and uniquely-numerated faces sum to a constant, being the conformal constant, and the die thereafter characteristically 'allal conformant'. A proper set of such dice, suitable for playing the game in dimension M, shall be a complementary pair with the same parameters and indices Q, N, A and D having respective conformal constants summing to 2(N+1).

Otherwise, any die of the general case being xenal, may have some opposed pairs of singular and uniquely-numerated faces sum to various different numbers, there being kinds symmetric and asymmetric, the former for cases of multiplicative and singular faces together grouped by three-dimensional rotational symmetry as tetrahedral, octahedral &c, shall have a common property or metric, the latter if not. These cases do not permit the prior characterisation of pairs for a proper set.

By explicit intention the constructions here defined are for the purpose of producing weighted probability distributions for the dice as thrown, generating an incidental numerical topography for each round of game play, enhancing its tactical complexity and the playing experience. The choice of a dice set for play is a matter for the players, although it may be generally allowed that regular sets are preferred over conformal, that synal are preferred over allal, and that xenal are least preferred, unless there is a specific and agreed inclination for such a set.

Additional to the dice previously described, there may be a die Q4N3Sr4, with pairs of opposed faces 1|3, 2|2, suitable for play in a game with dimension M=6.

Additionally there may be a die Q6N4Ar5 with pairs of opposed faces 2|3, 1|4, 3|3, suitable for play in a game with dimension M=8.

Additionally there may be a die Q8N5Ac7 with pairs of opposed faces 1|5, 2|2, 5|1, 3|4 and a complementary die Q8N5Ac5 1|5, 4|4, 5|1, 2|3, suitable for play in a game with dimension M=10.

Additionally there may be a die Q8N6Sr7 with pairs of opposed faces 2|2, 5|5, 1|6, 3|4, suitable for play in a game with dimension M=12.

Additionally there may be a die Q8N7Sc7 with pairs of opposed faces 7|7, 1|6, 2|5, 3|4 and a complementary die Q8N7Sc9 1|1, 2|7, 3|6, 4|5, suitable for play in a game with dimension M=14.

Additionally there may be a die Q12N5Ac7 with pairs of opposed faces 1|1, 2|2, 3|3, 4|4, 5|5, 5|2 and a complementary die Q12N5Ac5 1|1, 2|2, 3|3, 4|4, 5|5, 3|2, suitable for play in a game with dimension M=10.

Figure 7:
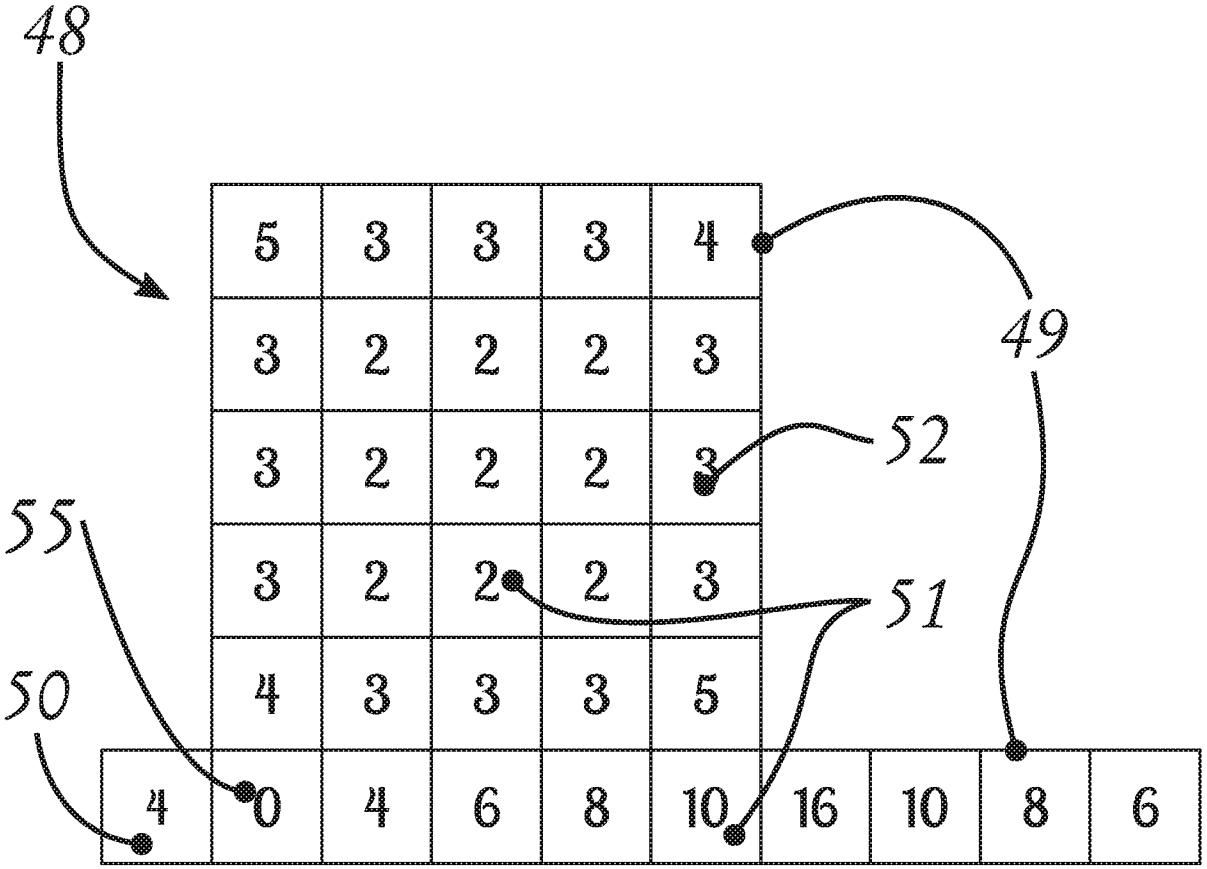
FIG. 7 is a diagram of a movement probability net for the dice of FIG. 6.

Additionally there may be dice not here specified, consistent with the constructions given. Referring now to FIG. 7, there is shown a movement probability grid 48 for the particular dice, 41*a* and 41*b*, shown in FIG. 6, for an arbitrary cell, and being the numerical topography of the field of play. The grid 48 comprises a collection of adjacent squares 49, comprising a reference square 50 at the bottom left hand corner of the grid 48, and movement squares 51 constituting the remainder of the squares 49. Each movement square 51 represents a movement away from the reference square 50 in the right and forward quadrant, which in turn represents movement of cells on the playing field. Each movement square contains a number 52 which gives the relative probability of attaining the square from the reference square by a proper roll of the dice, and absolutely gives parts in twice the square of the number of faces on the dice, here 72. For alternative dice with a different number of faces 42, it is noted that the number of squares 49 in a grid 48 may differ. For alternative dice with different duplicate numbers 43, it is noted that the numbers 52 shown in the grid 48 may differ.

The achievement of cells in the right backward quadrant is found by rotating the movement probability net a quarter turn clockwise around the reference cell; the achievement of cells in the left forward quadrant is found by rotating the movement probability net a quarter turn counter-clockwise about the reference cell, and the achievement of cells in the left backwards quadrant is found by rotating the movement probability net a half turn about the reference cell.

By way of example, the movement square immediately to the right of the reference square represents a movement of a playing piece 13 (discussed further below) by one cell 55 to the right on the field 16, but has zero probability of occurring. Whereas, the movement square immediately above/forward of the movement square immediately to the right of the reference square, represents a movement of a playing piece 13 by once cell 55 to the right and once cell forward (away from the player) on the playing field, and has a 4/72 chance of being available to the player on any given dice roll. As a further example, the movement square located five squares to the right and three squares forward/above represents a combined movement on the field of five cells to the right and three cells forwards, and has a 3/72 chance of being available to the player on any given roll of the dice.

Figure 8:
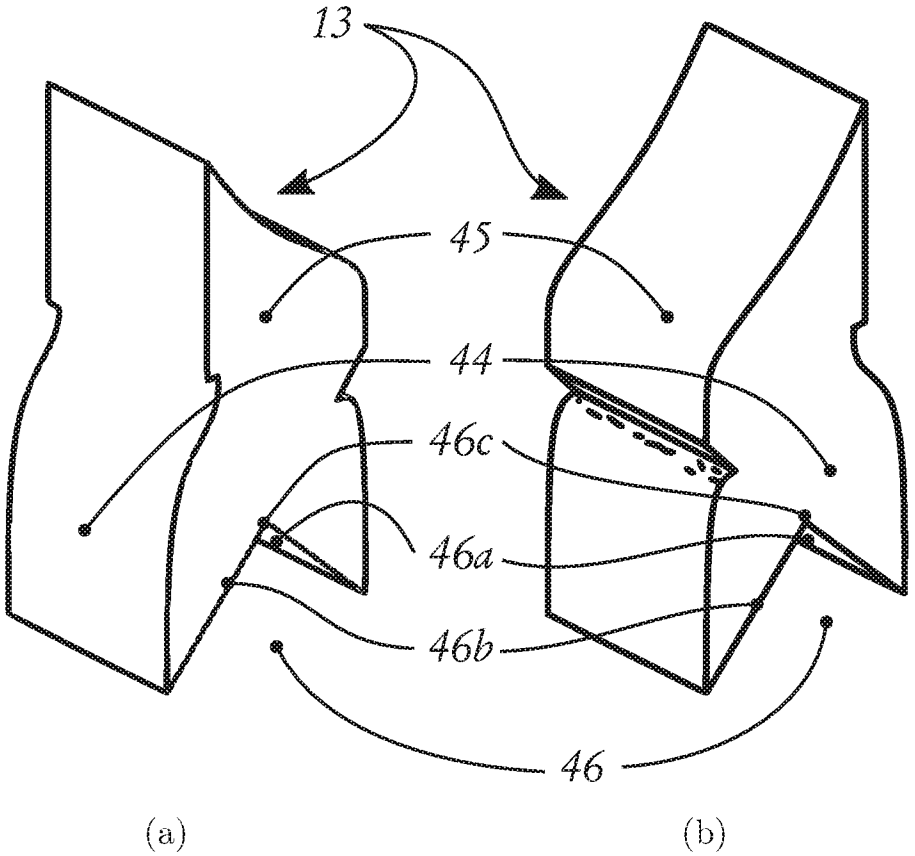
FIG. 8(*a*) is a front perspective view of a playing piece of the game kit.

FIGS. 8(*a*) and 8(*b*) show a playing piece 13 having a base portion 44 and a top portion 45. The base portion 44 has an undersurface 46 which is shaped to correspond with a ridge 31. The undersurface 46 is divided into a first aspect 46*a* and a second aspect 46*b*. The first and second aspects, 46*a* and 46*b*, meet centrally and perpendicularly at an apex 46*c*. Thus, when the piece is placed in an upright position, such as when placed on a ridge, each of the first and second aspects of the undersurface slopes downwardly from the apex 46*c* in opposite directions, at an angle of 45 degrees from the horizontal. When placed on a ridge 31, the apex 46*c* of the piece 13 is aligned atop and in contact with the apex 34 of the ridge, the first aspect 46*a* of the undersurface of the piece 13 is aligned atop and in contact with the first face 32 of the ridge, and the second aspect 46*b* of the undersurface of the piece 13 is aligned atop and in contact with the second face 33 of the ridge. Such a configuration enables quick and easy removable placement of playing pieces 13 on to ridges 31, and specifically on to a particular column of a particular ridge.

The top portion 45 of playing pieces is variable in shape and configuration, and decorative in nature, to the extent that it lends itself to easy grasping by a player and does not weight the piece in a manner causing it to topple too easily when perched on a ridge. Each playing piece 13 is structured to fit entirely within the borders of a cell 37 in order to minimise encroachment into other cells and interference with other pieces.

When not in play, playing pieces, dice and scoring flags are stored in the holding recesses. To initiate play, players will roll their dice into their throwing bowls, repeating if necessary, with the highest score having the choice of squares for the setting up of pieces and the first move subsequently. The first player so determined then mounts their pieces on either the odd squares or the even squares of the rows most adjacent to them, and the second player mounts their pieces on the squares of opposite character to that taken by the first player, on their most adjacent rows.

For the first player, the cells of their backmost or farthest row visibly numbered in the opposite character to that chosen for mounting their pieces will be their home cells, as, in FIG. 5, 56*a* will be home cells for a player mounting on the even-numbered cells. For the second player, the cells of their backmost or farthest row visibly numbered in the opposite character to that mounting their pieces will be their home cells, as, in FIG. 5, 56*b* will be home cells for a player mounting on the odd-numbered cells.

With pieces mounted and home cells determined players take alternate turns to throw their dice and move their pieces. A move is made by either:

Moving any piece left or right (from the player's vantage point) across the cells by the number given on one die, and forward or backward (from the player's vantage point) by the number given on the other die; or Moving any piece left or right, or forward or backward, by the sum of the two dice.

Moves left or right can carry over through the side of the board. Moves that carry over from the right side of one row will re-enter through the left side of that same row, and similarly moves that carry over from the left side of one row will re-enter through the right side of that same row. Moves forward or backward cannot carry over.

The number of cells traversed in the chosen directions during a move must be equal to the sum of scores or pointage rolled on both dice. A move that leaves some dice points unused is not allowed. However, where both dice show N, with total M, the player may nominate a piece for a dummy move where the points are considered to be played as a sum in the left-right direction and the piece remains in position.

A piece must be moved if touched during a player's turn after they have rolled the dice. However, a player can adjust their pieces after their opponent has completed their move and before they throw their dice.

Each post/cell can hold only one piece. Where a piece is moved to a cell occupied by an opponent's piece, the opponent's piece is considered captured and removed from the board.

In order to mitigate the advantage of half a move given to the player with the highest scoring initial die roll, the second player has the option of calling 'seconds' after their throw on one turn only at any stage of the game. This annuls the called throw and allows them to take their throw again.

Play continues until one player has secured a win by either:

Capturing all of the opponents pieces and removing them from the board; or

Where the they have N (equals five in this embodiment) or more number of pieces remaining, having pieces on all of their home cells/posts; or Where they have less than N pieces remaining, by having all of those pieces on their home cells.

However, a player who captures an opponent's piece located on one of their own home cells, and thereby brings about a winning condition for their opponent (i.e. all opponent's remaining pieces located on opponent's home cells), shall concede the win, notwithstanding that they have achieved a winning condition themselves, on the principle of prior position.

A single game is called a frame. Players can play a multi-frame match, called a set. When playing a set, the first play of each frame is alternated between players.

Points are awarded for wins in each frame. For instance, four points are awarded for removing all of an opponent's pieces from the board. Three points are awarded for occupying all of their home cells, with N or more pieces remaining. Two points are awarded for placing all of their pieces, being less than N, on their home cells. The running score can be kept by placing indicators, such as pins or flags 14, into holes 22 of the scoring rack 21. The player who first reaches seventeen points wins the set. Alternatively, a short set can be played to a (usually odd) agreed number of points of 5 or more.

The version of the game described advantageously provides both educational and recreational aspects. The educational aspect of the game is manifested in the movement of pieces on a numbered board as determined by the throw of dice. As will be evident from the characteristics of the playing field and the rules of the game, this engages the basic arithmetic skills of the sums and differences of two-digit numbers, including the properties of complement subtraction, which is typically taught in lower-primary levels of a conventional educational program. It additionally exercises the features and usage of grid co-ordinate systems. The recreational aspect of the game is manifested in the ease of play, the variety of options available to the player on each cycle of play, the changing circumstances which develop during the course of play, and the emergence through play of opportunities for the decisive tactical insights which lead a player to the win. In general, the game is fast-paced and competitive. Outcomes are decided by exercising appropriate tactical initiative at an opportune stage of the play. Games can end suddenly and reverse apparent advantage, leading to a high level of engagement. The game is generally suitable for players aged 5 and above.

Figure 9:
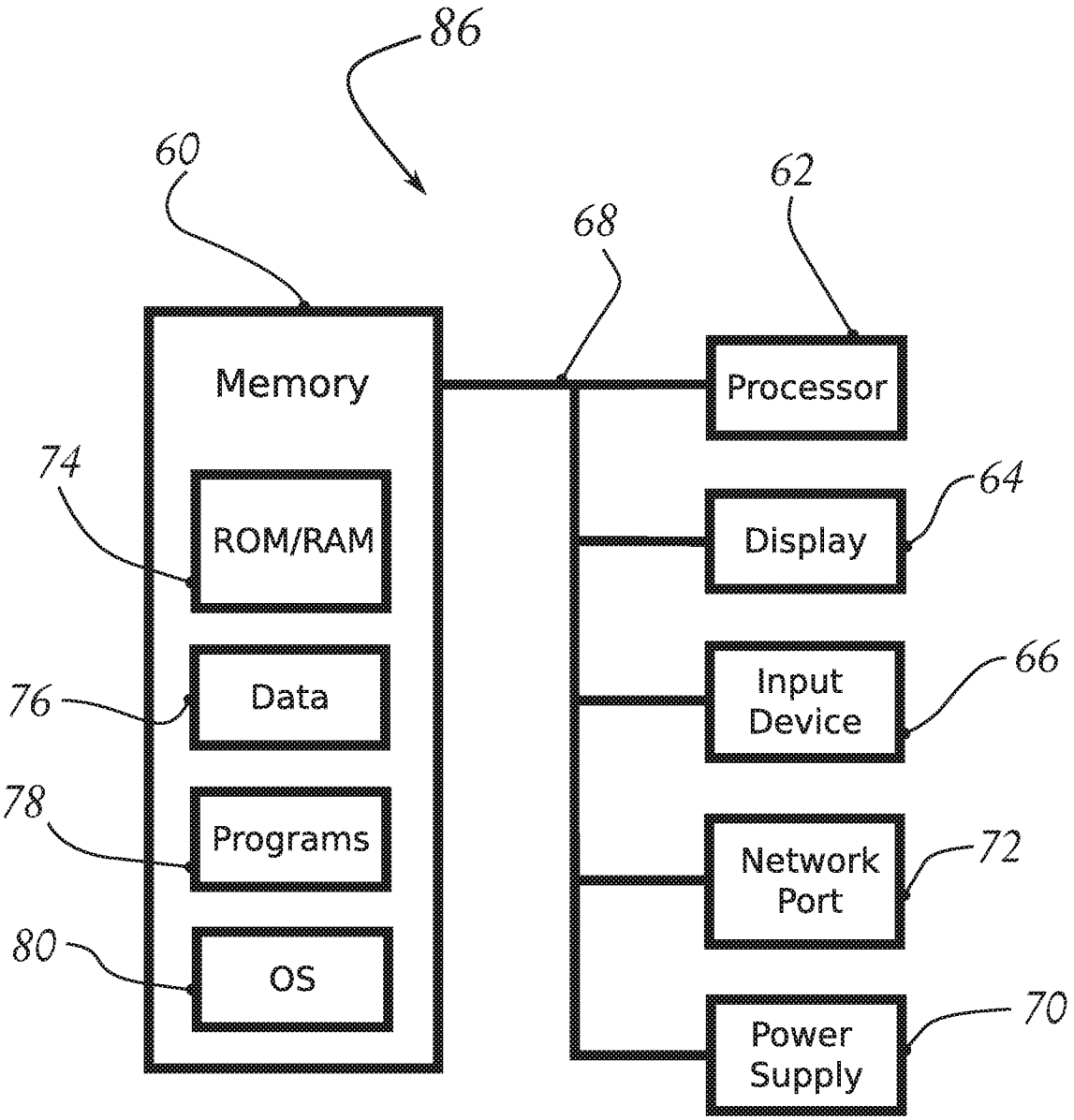
FIG. 9 is a block diagram of hardware typically associated with a computing device or system which may be used to implement the game or features thereof in virtual form.

The game may be played in physical or virtual form. FIG. 9 shows a block diagram of hardware typically associated with a computing device 84 or system 82 (see FIG. 10) of devices 84 or hardware components used to implement the game or features thereof in virtual form. The hardware includes a memory 60 central processor 62, display unit 64, input device 66 linked by a bus 68. Power is provided to these units by a power supply 70. A communications connection 72 serves as a port to other devices and/or networks. The memory 60 may include ROM/RAM 74, stored data 76, programs and applications 78 containing collections of instructions for performance of a specific task, and an operating system 80. The input device may comprise a keyboard, mouse, and/or touch screen.

The operating system 80 and computer programs 78 may be physically embodied in a computer-readable medium such as one or multiple fixed and/or removable data storage devices. As a specific example, the operating system 80 and computer programs 78 may be stored on a hard drive, or DVD's inserted into and read by an external drive. The programs 78 comprise instructions which are readable and executable by the processor 62.

The computer programs 78 and operating system 80 may be loaded from the data storage devices into the ROM 74 where it is more quickly accessible for execution by the central processor 62. When a computer program 78 is executed by the processor 62, a resulting output of the program may be displayed as an interface on a screen 64. It is the execution of program instructions by the central processor that leads the processor to perform steps necessary to implement features of the present invention.

Figure 10:
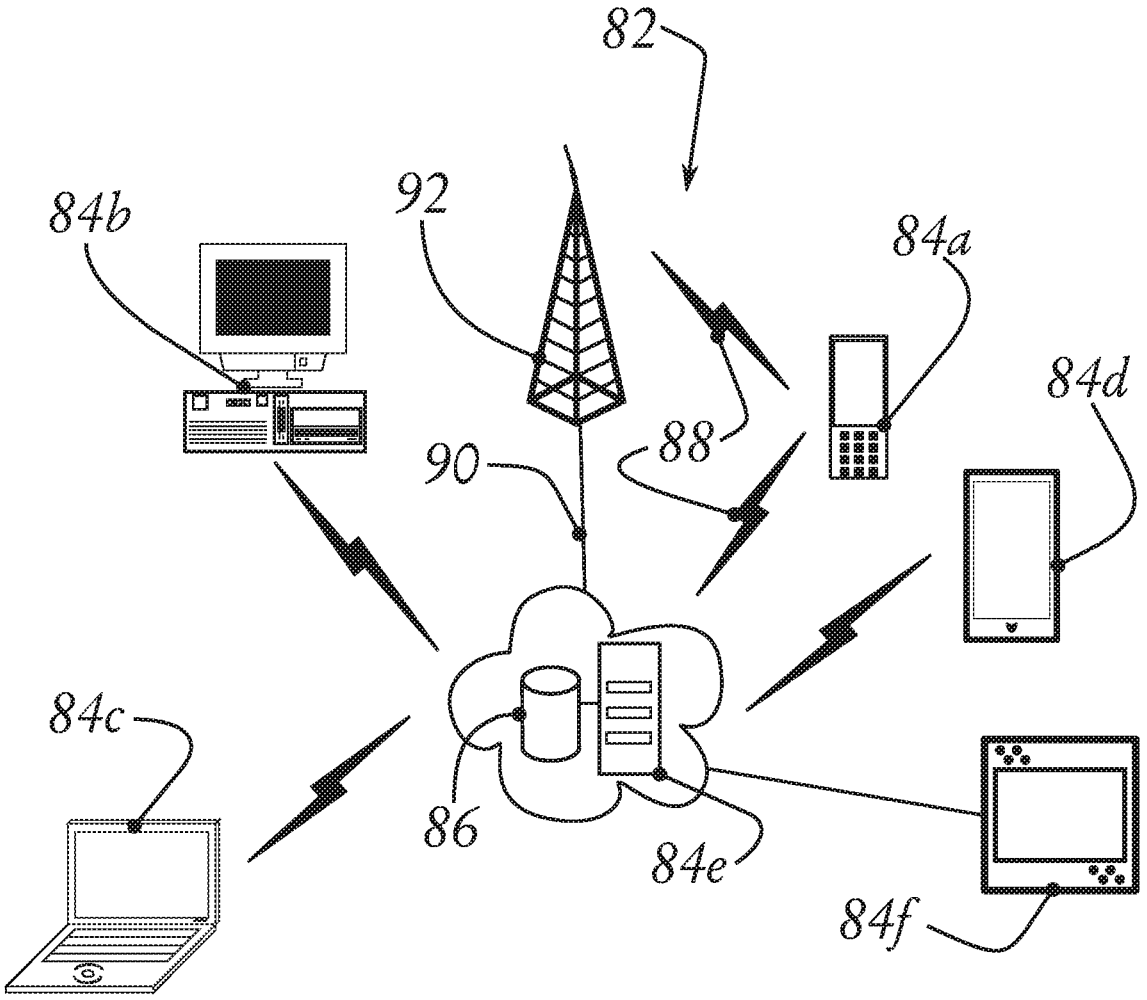
FIG. 10 is an exemplary infrastructural system including various computing devices which may be used independently or together to implement the invention.

Referring now to FIG. 10, there is shown an exemplary networked infrastructural system 82 including various computing devices 84 which may be used independently or together to implement the invention. The infrastructural system comprises a network, which in the exemplary embodiment comprises a mobile telephone network and the internet, but which may additionally or alternatively comprise a LAN, WAN, Ethernet, token ring, etc., or combination thereof, with which the devices 84 can communicate. This enables, for instance, input and output data to be communicated via the network to and from other devices 84.

In the exemplary embodiment the system 82 includes computing or processing devices 84 in various forms such as a mobile/cellular phone 84*a*, a desktop computer 84*b*, a laptop computer 84*c*, a tablet 84*d*, a dedicated gaming machine 84*f* (such as those found at pool halls) and a server 84*e*, although it is envisaged that the network may additionally or alternatively comprise other computing devices. Transfer of data between the network and one or more databases 86 can be facilitated by the server 84*e*.

Interconnections between devices facilitating transfer of data and/or information over the network 82 may be wholly or partially wired 90, for example by optical fibre, or wireless 88, for example by utilising Wi-Fi™, Bluetooth™, cellular, or satellite communications networks.

In the exemplary embodiment, the network 82 comprises a telecommunications network, such as wireless GSM or 3G networks, connected with a receiving/transmitting station 92, which is connected with wireless devices such as mobile or cellular telephones 84*a*, thereby facilitating transfer of data thereto and therefrom.

It is envisaged that in other embodiments, the network may comprise a satellite communications network which is connected with a satellite signal receiver that remotely receives data from a satellite. The satellite communicates with a satellite signal transmitter which in turn communicates with further terminals such as desktop computers, servers, laptops, mobile phones, etc.

It is to be appreciated that the networked infrastructural system 82 represents only a single example of infrastructure which may be suitable for implementing aspects of the invention. Other suitable networked systems for implementing the invention may involve various alternative devices, configurations, networks, or architectures without departing from the scope of the present invention.

While this invention has been described in connection with specific embodiments thereof, it will be understood that it is capable of further modification(s). The present invention is intended to cover any variations, uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the broad consistory statements. Various modifications and equivalent arrangements are intended to be included within the spirit and scope of the invention and consistory statements herein. Therefore, the specific embodiments are to be understood to be illustrative of the many ways in which the principles of the present invention may be practiced.

Where the terms "comprise", "comprises", "comprised" or "comprising" are used in this specification, they are to be interpreted as specifying the presence of the stated features, integers, steps or components referred to, but not to preclude the presence or addition of one or more other features, integers, steps, components to be grouped therewith.

The invention claimed is:

1. A game kit comprising:

a game board that provides a rectangular field with first and second pairs of opposite sides, the game board further comprising a plurality of prismatic ridges that rise above the field and extend between the sides of the first pair of opposite sides in a series of adjacent prismatic ridges with the series extending between the sides of the second pair of opposite sides, each ridge has a first face that faces a first side of the second pair of opposite sides for facing a first player at the first side and second face that faces a second side of the second pair of opposite sides for facing a second player at the second side, the first and second faces of each ridge converging upwardly from the field and away from each other to an apex of the ridge that extends between the sides of the second pair of opposite sides whereby the first side is visible to the first player and less readily visible to the second player and the second side is visible to the second player and less readily visible to the first player and whereby, for each pair of adjacent ridges, the first face of one ridge of the pair meets with the second face of the other ridge of the pair along a trough or gutter between the ridges of the pair, wherein the ridges are visually divided into cells, the cells being arranged side by side, lengthwise along respective ridges to form rows of cells, and the cells of respective ridges being aligned to form columns of cells, a number of cells per column being equal to a number of cells per row, the columns and rows of cells forming a cell grid, wherein each cell extends over first and second faces of its respective ridge, such that each cell comprises a first cell face on the first face of the ridge and a second cell face on the second face of the ridge, wherein each of the cell faces comprises a two-digit grid co-ordinate in a numeral base, each two-digit grid co-ordinate forming a numeral with an integer value, the numerals being arranged in a sequence, wherein adding the numeral on a first cell face of a cell to the numeral on the corresponding second cell face of the cell results in a value equal to the number of cells per row or column squared minus one; and multiple playing pieces, each playing piece comprising a base which corresponds to the faces of the ridges, wherein the base of each playing piece comprises first and second downwardly facing faces which slope, on average, down and away from each other to cover the two opposite faces of a ridge of a cell on the board, and the playing pieces further comprising two upright outer walls rising from the two downwardly facing faces configured to avoid encroachment when two playing pieces are occupying two adjacent cells in two adjacent ridges.

2. The game kit according to claim 1, wherein the second face of each ridge is visible to the first player and less visible to the second player sitting opposite the first player, and the first face of each ridge is visible to the second player and less visible to the first player.

3. The game kit according to claim 1, wherein first and second faces of each ridge slope, on average, down and away from each other at an angle in the range of 30 to 150 degrees.

4. The game kit according to claim 1, wherein the first and second face of each ridge extend down and away from each other at an angle which is substantially perpendicular.

5. The game kit according to claim 1, wherein the prismatic ridges are triangular prismatic ridges, without a gap at the ridge apex.

6. The game kit according to claim 1, wherein there are between six and twenty ridges in the series, inclusive.

7. The game kit according to claim 1, wherein first and second faces of each ridge slope, on average down and away from each other at an angle in the range of 45 to 135 degrees.

8. The game kit according to claim 1, wherein the first and second faces of each ridge slope, on average down and away from each other at an angle in the range of 60 to 120 degrees.

9. The game kit according to claim 1, wherein a first set of integer values increases from cell face to cell face from left to right of the board, and a second set of integer values increases from cell face to cell face from right to left of the board.

10. The game kit according to claim 1, further comprising a die comprising four or more faces, each face indicating a numeric value, wherein at least one of the numeric values is indicated on at least two of the faces.

11. The game kit according to claim 10, wherein at least one of the numeric values of the die occurs more often than at least one remaining numeric value, such that a probability distribution of numeric values is weighted.

12. The game kit according to claim 10, wherein the die comprises a full range of integer numeric values from one up to a value equal to the number of faces minus one.

13. The game kit according to claim 10, wherein the die contains six, eight, ten, twelve, or sixteen faces.

14. The game kit according to claim 11, wherein the or each of the numeric values of the die which occurs more often than the at least one remaining numeric value, occurs only once more often.

15. The game kit according to claim 10, wherein dividing the number of faces of the die by the highest integer value leaves a non-zero remainder.

16. The game kit according to claim 1, further comprising a pair of first and second isohedral dice, wherein:

the first die comprises four or more faces, each face indicating a numeric value, the first die comprising a full range of integer values from one up to a highest value which is less than the total number of faces, wherein at least one of the numeric values is indicated on at least one pair of opposed faces, wherein the or each pair of opposed faces indicating the highest most often repeated numeric value sum to a first repeat value, while pairs of opposed faces indicating unequal numeric values sum to a first constant value, and at least one of the numeric values occurs more often than at least one remaining numeric value, such that a probability distribution of numeric values is weighted;

the second die comprises four or more faces, each face indicating a numeric value, the second die comprising a full range of integer values from one up to the same highest value as the first die, that being less than the total number of faces, wherein at least one of the numeric values is indicated on at least one pair of opposed faces, wherein the or each pair of opposed faces indicating the highest most often repeated numeric value sum to a second repeat value, while pairs of opposed faces indicating unequal numeric values sum to a second constant value, and at least one of the numeric values occurs more often than at least one remaining numeric value, such that the probability distribution of numeric values is weighted; and the sum of first and second repeat values, divided by two, is equal to the highest value plus one, or the sum of first and second constant values, divided by two, is equal to the highest value plus one.

17. The game kit according to claim 1, further comprising an isohedral die comprising eight or more faces, each face indicating a numeric value, the die comprising a full range of integer values from one up to a highest value which is less than the total number of faces, wherein at least one of the numeric values is indicated on at least one pair of opposed faces, while pairs of opposed faces indicating unequal numeric values sum to a constant value, and at least one of the numeric values occurs more often than at least one remaining numeric value, such that the probability distribution of numeric values is weighted, and wherein dividing the number of faces by the highest integer value leaves a non-zero remainder.

18. The game kit according to claim 17, wherein the die comprises a full range of integer numeric values from one up to a value equal to the number of faces minus one.

19. The game kit according to claim 17, wherein the, or each, of the numeric values of the die occurring more often than the at least one remaining numeric value, occurs only once more often.

20. The game kit according to claim 17, wherein the die contains eight or twelve faces.

* * * * *